US012605586B2

(12) United States Patent
Gubera

(10) Patent No.: US 12,605,586 B2
(45) Date of Patent: Apr. 21, 2026

(54) NECK STRENGTHENING SYSTEM AND METHOD

(71) Applicant: Evan Gubera, Greenville, SC (US)

(72) Inventor: Evan Gubera, Greenville, SC (US)

( * ) Notice: Subject to any disclaimer, the term of this patent is extended or adjusted under 35 U.S.C. 154(b) by 73 days.

(21) Appl. No.: 18/602,317

(22) Filed: Mar. 12, 2024

(65) Prior Publication Data

US 2025/0288854 A1 Sep. 18, 2025

(51) Int. Cl.

| | |
|---|---|
| ***A63B 21/00*** | (2006.01) |
| ***A42B 1/02*** | (2006.01) |
| ***A42B 1/22*** | (2006.01) |
| ***A63B 21/04*** | (2006.01) |
| ***A63B 21/065*** | (2006.01) |
| ***A63B 23/025*** | (2006.01) |

(52) U.S. Cl.

CPC ..... *A63B 21/4003* (2015.10); *A42B 1/02* (2013.01); *A42B 1/22* (2013.01); *A63B 21/0442* (2013.01); *A63B 21/065* (2013.01); *A63B 21/151* (2013.01); *A63B 23/025* (2013.01)

(58) Field of Classification Search

CPC .. A42B 1/017; A42B 1/02; A42B 1/22; A63B 21/0442; A63B 21/065; A63B 21/151; A63B 21/4003; A63B 23/025

See application file for complete search history.

(56) References Cited

U.S. PATENT DOCUMENTS

| | | | | |
|---|---|---|---|---|
| 1,543,346 | A * | 6/1925 | Titus | A63B 23/025 482/10 |
| 7,010,814 | B2 * | 3/2006 | Benziger | A63B 23/025 2/171.2 |
| 9,526,965 | B2 * | 12/2016 | Gatherer | A63B 21/4003 |
| 10,307,636 | B1 * | 6/2019 | Brown | A63B 21/4003 |
| 11,000,087 | B1 * | 5/2021 | Reynolds | A63B 21/4003 |
| 11,007,405 | B2 * | 5/2021 | Hunt | A63B 21/4025 |
| 11,241,057 | B2 * | 2/2022 | Bloniarz, Jr. | A42B 1/02 |
| 11,413,491 | B2 * | 8/2022 | Hunt | A63B 21/4025 |
| 2005/0043154 | A1 * | 2/2005 | Atrizadeh | A63B 21/00043 482/124 |
| 2014/0221161 | A1 * | 8/2014 | DePalma | A63B 21/4003 482/10 |
| 2015/0126294 | A1 * | 5/2015 | Williams | A42B 1/241 473/208 |
| 2024/0091583 | A1 * | 3/2024 | Parsons | A63B 21/16 |

* cited by examiner

*Primary Examiner* — Megan Anderson
(74) *Attorney, Agent, or Firm* — Sam Pierce

(57) ABSTRACT

According to an aspect of the present invention, there is provided system for exercising neck muscles, comprising: a hat; a first end of a loop extending from a hat; a second end of a loop extending from a hat; and a loop material connecting the first end of the loop to the second end of the loop.

8 Claims, 4 Drawing Sheets

NECK STRENGTHENING SYSTEM AND METHOD

BACKGROUND

A need has been recognized in the prior art patent literature for devices which allow for neck strengthening exercises.

One example of the prior art is U.S. Pat. No. 7,722,301, which describes a headgear device for assisting a user in performing bridge exercises to strengthen the muscles of the neck, and exercises performed using the device. The headgear outer surface has an area of low-friction material to allow the headgear to slide on an exercise surface while the user's head supports a portion of his body weight in the bridge position. This allows the user to introduce dynamic resistance into the exercise by moving around on the surface. One or more straps connectable to the user's arms and/or legs can be used to provide stability and/or resistance during the exercise. A friction pad adapted to be removably attached to the outer surface of the headgear can be used to provide resistance to the headgear sliding.

Another example is U.S. Pat. No. 4,339,124, which discloses a neck exercising device comprising in combination (a) a football helmet that is adapted to be strapped securely on the head; (b) an elongated steel bar located immediately above the central top portion of said football helmet with the longitudinal axis of said steel bar extending in an essentially vertical direction, (c) a curved steel plate which is about ⅛ inch thick, 2.5 inches in width and 6-7 inches in length, the curvature of said plate corresponding to the curvature of the top portion of said football helmet, the bottom end of said elongated steel bar being welded to the convex surface of said curved steel plate, (d) a rubber bushing having approximately the same size and shape as said curved steel plate, the entire undersurface of said rubber bushing being secured flush against the upper central surface of said football helmet and the entire undersurface of said curved steel plate being secured flush against the upper surface of said rubber bushing, said securement being effected by a plurality of fastening means that are located at spaced apart portions of said curved steel plate and which fastening means extend through both said curved steel plate, said rubber bushing and the upper central portion of said football helmet, (e) at least one bar bell disc with a central bore mounted on said vertically disposed steel bar, each said bar bell disc being disposed in a generally horizontal plane and bearing its weight downwardly on the top of said curved steel plate, and (f) a locking collar mounted on said steel bar at a point immediately above the upper most bar bell disc so as to secure said bar bell disc against upwardly movement.

Prior art patents including the examples above, however, are lacking in at least convenience, flexibility for a range of exercises, safety, and cost-effectiveness.

SUMMARY OF INVENTION

Thus, the present invention provides improved devices, systems, and methods for neck strengthening exercises.

According to an aspect of the present invention, there is provided system for exercising neck muscles, comprising: a hat; a first end of a loop extending from a hat; a second end of a loop extending from a hat; and a loop material connecting the first end of the loop to the second end of the loop.

In various aspects of the present invention, the loop on the hat is connected to a cord hanging a weight, a cable machine, or a resistance band. In a preferred embodiment, the loop that holds the weight is attached in the rear of the hat and the hat is adjustable as hats normally are.

DETAILED DESCRIPTION OF THE DRAWINGS

Figure 1:
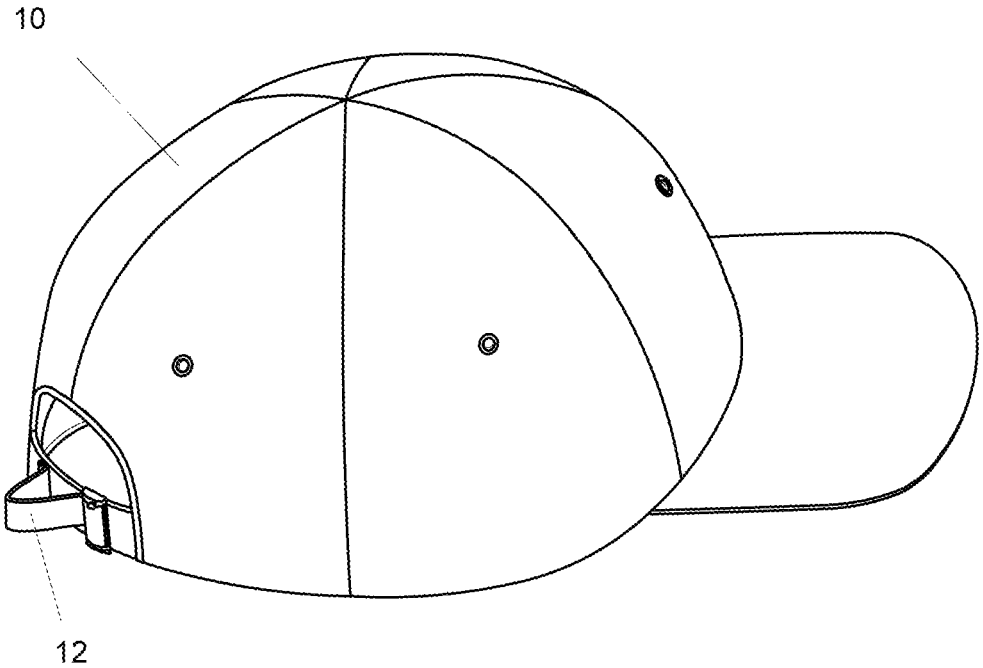
FIG. 1 illustrates a device for attaching a neck strengthening mechanism to a hat according to an embodiment of the present invention.

FIG. 1 illustrates a device for attaching a neck strengthening mechanism to a hat according to an embodiment of the present invention.

Hat 10 is provided with loop 12. Loop 12 in a preferred embodiment extends from the rear of hat 10 from the part of hat 10 which can be used to adjust the sizing and fit of hat 10 on the head of the wearer. However, loop 12 can extend from other portions of the a in other embodiments, such as the side of a hat.

Loop 12 can be made of the same material as the adjustable portion for sizing, i.e., the buckle and can be continuous with the strap of the buckle or can be made of a different material.

Hat 10 can be in the style of a baseball cap but is not so limited. In a preferred embodiment, hat 10 has added stitching for strength in comparison to a typical baseball cap. The buckle of hat 10, i.e., the adjustable portion is also typically reinforced compared to a typical baseball cap.

Loop 12 extends outward from hat 10 so as to create a space between loop 12 and hat 10 which can be used for applying a force, i.e., a weight to loop 12. In a preferred embodiment, loop 12 is made of a sturdy material to support a weight applied to it, such as a durable fabric or leather, for example.

Figure 2:
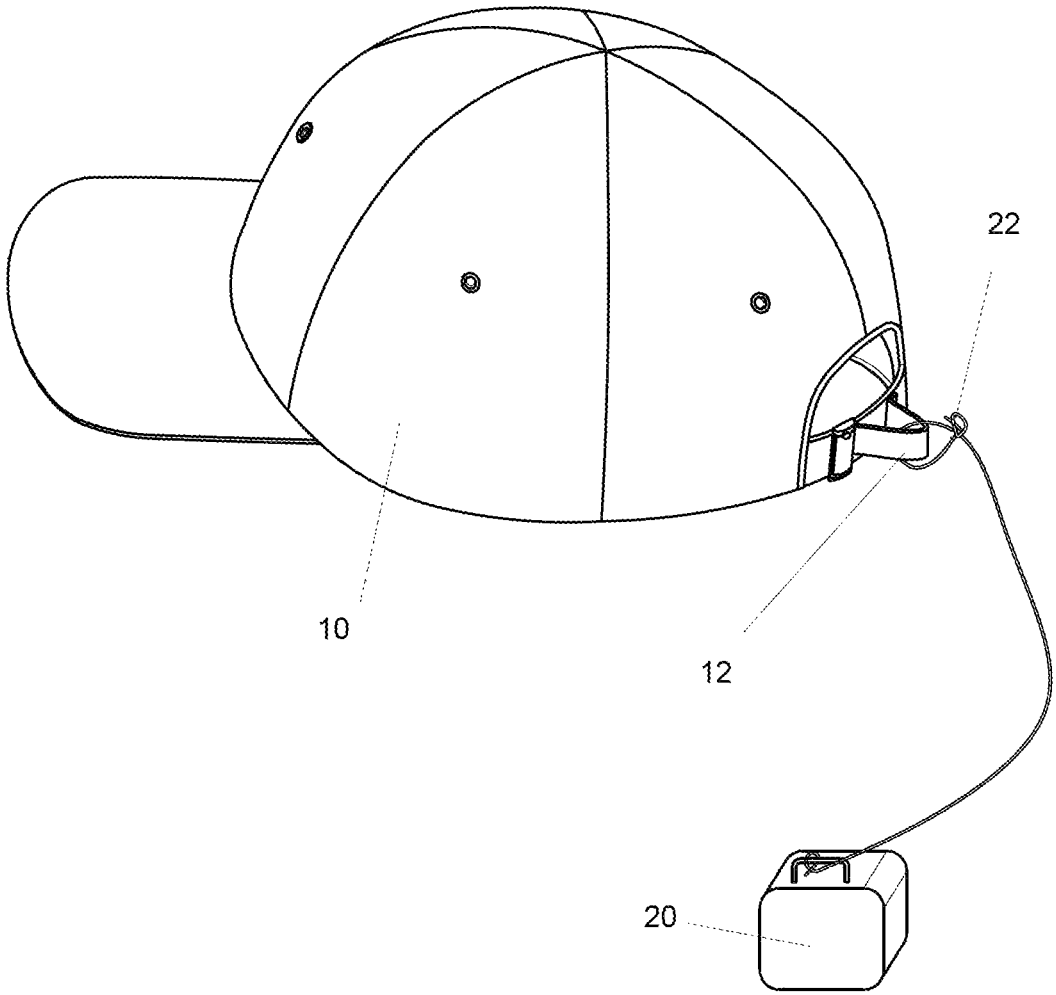
FIG. 2 illustrates a weight attached to a hat in an embodiment of the present invention.

FIG. 2 illustrates a weight attached to a hat in an embodiment of the present invention.

Hat 10 provided with loop 12 is attached to weight 20 by cord 22. On one end of cord 22, cord 22 runs through loop 12 and is tied to the material of loop 12.

On the other end of cord 22, cord 22 is attached to weight 20, which could be by a slot on weight 20 or in other embodiments cord 22 could be integral to weight 20.

Weight 20 can be a variety of shapes, styles, and masses, depending on the neck strength of the user. In some embodiments the weight of the cord itself may provide substantial enough mass for the desire of a particular wearer.

The user can exercise their neck by moving their neck in various directions side to side or forward and backward or rotationally, resisted by the weight of weight 20.

By moving the wearer's neck in various directions the wearer is able to achieve exercising and strengthening of the wearer's neck muscles as well as other accessory muscles in the head and shoulder area of the wearer.

Figure 3:
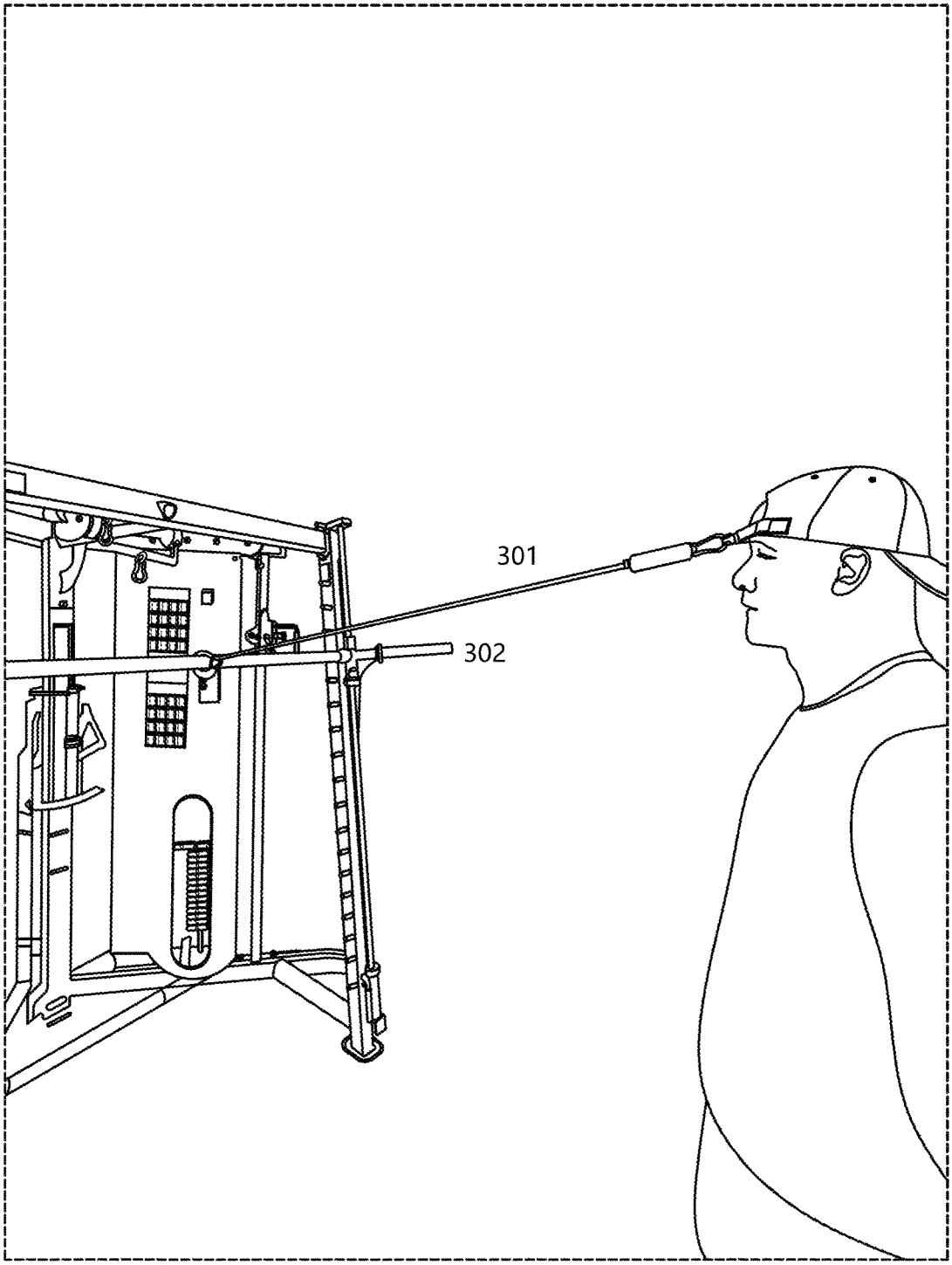
FIG. 3 illustrates use of the hat according to another embodiment.

FIG. 3 illustrates use of the hat according to another embodiment.

The hat of the present invention can be used with a resistance band in a preferred embodiment. A resistance band is tied to the loop of present invention and a fixed object, which could be an exercise machine as shown in FIG. 3.

When used in the present invention, resistance bands build strength by providing tension that neck muscles have to work to resist. The further a user stretches a band by moving their head, the more resistance their neck muscles are working against.

Resistance bands are generally made of latex or fabric. Resistance bands are available in either an elastic fabric or rubber latex, and which is best comes down to personal preference. Fabric bands do not slide but latex bands can offer more stretch.

Figure 4:
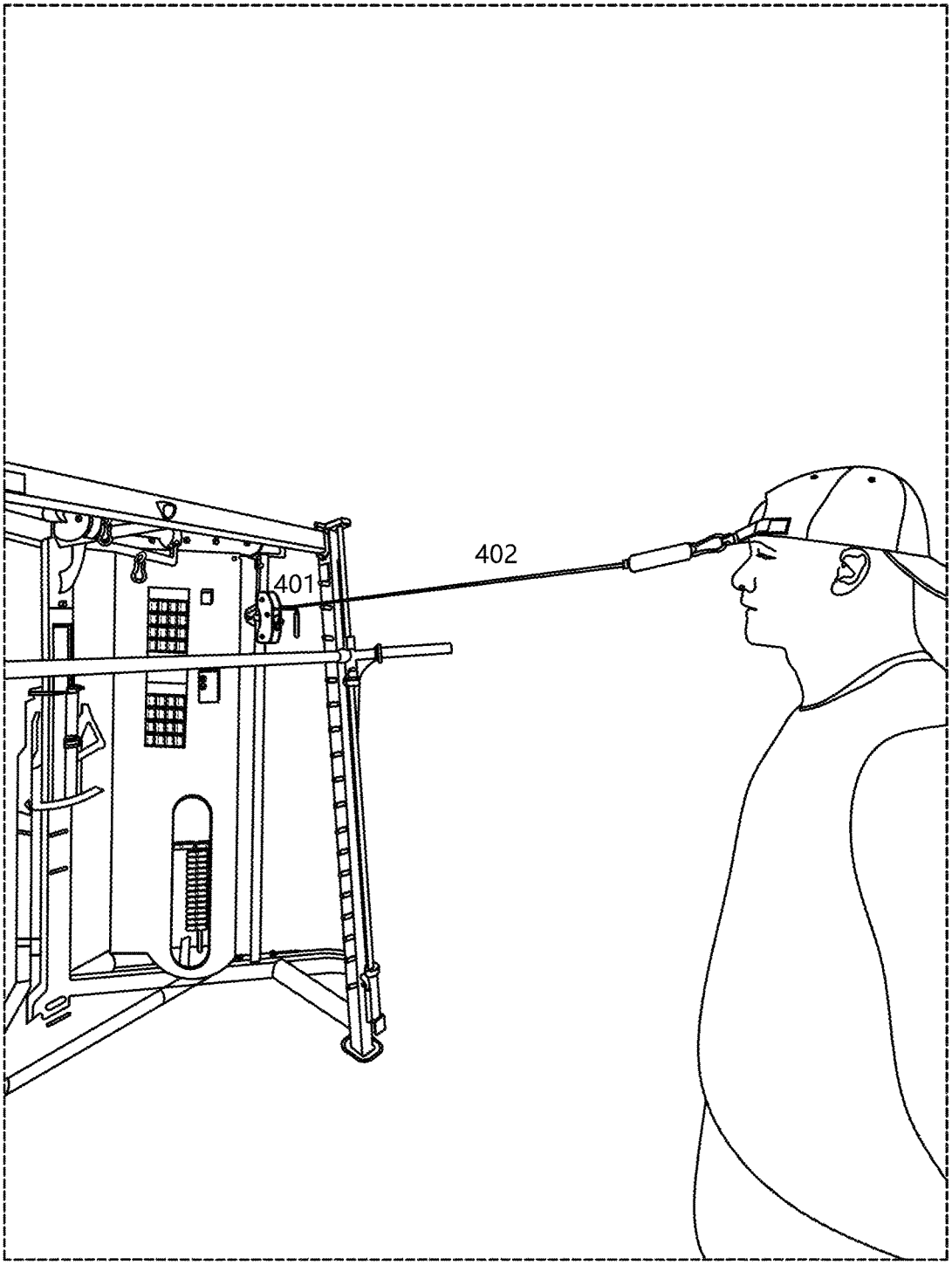
FIG. 4 illustrates use of the hat according to yet another embodiment.

FIG. 4 illustrates use of the hat according to yet another embodiment.

The hat of the present invention can also be attached to a cable machine itself. A cable machine, or cable crossover machine, is one piece of workout equipment available.

Typically a cable machine has one or two weight stacks, pulley systems, cable attachments, and can have other features such as pull bars as well. The cable can be attached to the weight stack so that the weight stack must be lifted to pull the cable.

When the loop on the hat of the present invention is attached to a cable machine, the user can adjust the amount of weight that is connected to the cable, and thus the user can adjust the intensity of their neck muscle exercise accordingly.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description.

Other embodiments may be utilized and derived from the present invention, such that structural and logical substitutions and changes may be made without departing from the scope of this disclosure.

Figures are also merely representational and may not be drawn to scale. Certain proportions thereof may be exaggerated, while others may be minimized. Accordingly, the specification and drawings are to be regarded in an illustrative rather than a restrictive sense. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments.

Combinations of the above embodiments, and other embodiments not specifically described herein, will be apparent to those of skill in the art upon reviewing the above description. Therefore, it is intended that the disclosure not be limited to the particular embodiment(s) disclosed.

What is claimed is:

1. A system for exercising neck muscles, comprising:

a hat;

a hat closure, wherein the hat closure is configured to create a continuous circle in a plane of a bottom perimeter of the hat to secure the hat around a head of a user;

a first end of a loop extending from the hat closure;

a second end of a loop extending from the hat closure;

a loop material connecting the first end of the loop to the second end of the loop, wherein the loop material defines an open space between the hat closure and the loop material; and a string attached to a weight inserted in the open space and tied to the loop material, wherein the weight is positioned at the end of the string so that a direction of a force applied by the weight is perpendicular to the continuous circle in the plane of the bottom perimeter of the hat.

2. The system for exercising neck muscles according to claim 1, further comprising a buckle for adjusting the size and fit of the hat.

3. The system for exercising neck muscles according to claim 1, wherein the hat is a baseball cap.

4. The system for exercising neck muscles according to claim 1, wherein the loop material is fabric.

5. The system for exercising neck muscles according to claim 1, wherein the loop material is leather.

6. A system for exercising neck muscles, comprising:

a hat;

a hat closure, wherein the hat closure is configured to create a continuous circle in a plane of a bottom perimeter of the hat to secure the hat around a head of a user;

a first end of a loop extending from the hat closure;

a second end of a loop extending from the hat closure;

a loop material connecting the first end of the loop to the second end of the loop, wherein the loop material defines an open space between the hat closure and the loop material; and a resistance band inserted in the open space and tied to the loop material.

7. The system of claim 6, wherein the resistance band is tied to a stationary object on an opposite end of the resistance band from the resistance band tied to the loop material.

8. A system for exercising neck muscles, comprising:

a hat;

a hat closure, wherein the hat closure is configured to create a continuous circle in a plane of a bottom perimeter of the hat to secure the hat around a head of a user;

a first end of a loop extending from the hat closure;

a second end of a loop extending from the hat closure;

a loop material connecting the first end of the loop to the second end of the loop, wherein the loop material defines an open space between the hat closure and the loop material; and a cable from a cable machine inserted into the open space and tied to the loop material.

* * * * *